US006199777B1

(12) United States Patent
Satake et al.

(10) Patent No.: US 6,199,777 B1
(45) Date of Patent: Mar. 13, 2001

(54) FLOUR MILLING METHOD HAVING A SORTING STEP FOR RAW WHEAT GRAINS AND FLOUR MILLING SYSTEM ADOPTING THE METHOD

(75) Inventors: Satoru Satake, Tokyo; Shigeharu Kanemoto, Hiroshima; Takeshi Munesada, Hiroshima; Yoshimasa Tomoyasu, Hiroshima, all of (JP)

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 09/285,693

(22) Filed: Apr. 5, 1999

(30) Foreign Application Priority Data

May 15, 1998 (JP) ..... 10-133709
Dec. 3, 1998 (JP) ..... 10-343985

(51) Int. Cl.[7] ..... B02C 9/04

(52) U.S. Cl. ..... 241/10; 241/11; 241/76; 241/81; 241/159

(58) Field of Search ..... 241/7, 10, 11, 241/9, 81, 76, 159

(56) References Cited

U.S. PATENT DOCUMENTS 798,267 * 8/1905 Cron ..... 241/10
3,362,649 1/1968 Odden et al. .
3,432,529 * 3/1969 Depmer ..... 241/10
5,250,313 * 10/1993 Giguere ..... 241/11

FOREIGN PATENT DOCUMENTS 196 32 976 2/1998 (DE) .
0 339 577 11/1989 (EP) .
0 788 840 8/1997 (EP) .

* cited by examiner

*Primary Examiner*—Mark Rosenbaum
(74) *Attorney, Agent, or Firm*—Fish & Richardson, PC

(57) ABSTRACT

A flour milling method and a flour milling system are provided, in which a plurality of milling steps whose milling degrees are different from one another are performed sequentially from an upperstream to a downstream, each of the milling steps including a breaking step and a grading step. The steps are carried out by sorting the raw wheat grains into regular wheat grains and material other than the regular wheat grains, forwarding the sorted regular wheat grains to the uppermost-stream milling step, and forwarding the sorted material other than the regular wheat grains to at least one of downstream milling steps at a downstream of the uppermost-stream milling step. The method and the system enable the production of wheat flour of better quality with better yield than that conventionally produced.

17 Claims, 6 Drawing Sheets

FLOUR MILLING METHOD HAVING A SORTING STEP FOR RAW WHEAT GRAINS AND FLOUR MILLING SYSTEM ADOPTING THE METHOD

BACKGROUND OF THE INVENTION (1) Field of the Invention

The present invention relates to a flour milling method and a flour milling system having steps of such as breaking, grading, purification and reduction for the flour milling of wheat grains, and more particularly to a flour milling method having a sorting step for raw wheat grains and a flour milling system adopting the method.

(2) Description of the Related Art

As in a cross-sectional view of an inside structure of a wheat grain, there is a plurality of layers called layers of pericarp, testa and aleuron sequentially positioned from a surface portion of the wheat grains, and there is starch and gluten-parenchyma further inside thereof. It is well known that ash contents are largely contained especially in the layers of pericarp, testa and aleuron within the above constituents. In this specification, the layers of pericarp, testa and aleuron are generally called an epidermis. The wheat grain also has a peculiar longitudinal groove called a crease portion which goes deep into the inside thereof.

FIG. 1 shows a flour milling flow 100 based on a conventional flour milling system which is for producing high quality product wheat flour and in which, after the raw wheat grains are polished, the polished wheat grains are milled through a plurality of breaking steps, and the wheat grains thus milled are sifted out or classified. After foreign matters such as small stones and metal pieces or fragments are removed at a cleaning unit 108, the raw wheat grains are introduced into a polishing unit 101. The raw wheat grains are polished at the polishing unit 101 and are forwarded to a first break 102 via a transporting passage 109. Wheat particles milled by the opposing rolls 102*a* and 102*b* of the first break 102 into particles of various sizes are sifted out by a sifter 103 into respective particle sizes. The wheat flour in a small particle size (e.g., smaller than 125 $\mu$m) becomes product flour, and the wheat flour in large particle size (e.g., larger than 850 $\mu$m) is forwarded to a second break 104. Generally, the wheat flour in an intermediate particle size is supplied to steps called such as smoothing (not shown), purification (not shown) and reduction (not shown).

The wheat flour forwarded from the first break 102 and introduced into the second break 104 at a downstream of the first break is milled by breaking, and the flour thus milled is sifted out by a sifter 105 into product flour whose particle size is small, wheat flour whose particle size is large, and semolina whose particle size is intermediate. Then, these kinds of flour thus sifted out are forwarded to respectively suited steps to follow. That is, at a third break 106 at a further downstream as shown in FIG. 1, the flour milled is sifted out by a sifter 107 and then is forwarded to appropriate steps according to particle sizes. The later the breaking step is, the larger the epidermis contents become in the raw materials introduced.

In the above described conventional flour milling system, irrespective of whether or not a wheat polisher is used, the sifting by employing such system as a sifter is used after the milling in order to produce high quality flour with a high yield. The quality of flour depends on how the wheat flour with little epidermis can be sifted out, and how a large volume flour with ash contents lower than the related standards can be produced.

That is, in order to produce quality flour with a high yield according to a conventional technique, it was necessary to establish a highly precise and highly efficient sifting technique. However, there is a limit in the technique in enhancing the purity of the wheat flour by the operation of sifting and purification means.

Even if a technique with which the epidermis at wheat surfaces is removed in advance by a wheat polisher is introduced, practically it is difficult at the present stage to produce wheat flour of a better quality by the operation of sifting and purification means.

SUMMARY OF THE INVENTION

It is an object of the present invention to provide a method and a system for producing flour of a better quality with high yields whereas there was a limit therein according to the conventional technique irrespective of whether the wheat polisher was used or not.

As a means to overcome the problem, the invention provides, according to one aspect of the invention, a flour milling method for raw wheat grains in which a plurality of milling steps whose milling degrees are different from one another are performed sequentially from an upperstream to a downstream, each of the milling steps including a breaking step and a grading step, the method comprising the steps of: sorting the raw wheat grains into regular wheat grains and material other than the regular wheat grains; forwarding the sorted regular wheat grains to a milling step of the uppermost-stream; and forwarding the sorted material other than the regular wheat grains to one of a plurality of milling steps of the downstream.

It is to be noted that the terms "upperstream" and "downstream" used in this specification mean "upperstream" and "downstream" respectively as viewed in the direction of flow of wheat.

When small grains have been removed from the raw wheat grains by the sorting step, the wheat grains to be forwarded to the first break become the regular wheat grains only. The fact that only such regular wheat grains are forwarded to the first break means that only the regular wheat grains in which the ratio of epidermis with respect to endosperm of the wheat is comparatively small are forwarded. Since there are no small grains in which the ratio of the epidermis with respect to the endosperm is comparatively large, the ratio of the epidermis of the wheat thus milled is inherently small. In this way, it is possible to produce wheat flour of a better quality than that conventionally produced.

According to the invention, it is arranged that the wheat grains having been sorted out are introduced into at least one of downstream breaks at a downstream of the first break. The ratio of the ash contents in the raw material is higher as the breaking steps are later. However, if the small grains which were sorted out prior to the first break and in which the ratio of epidermis is comparatively large are introduced into, for example, the third break, the ratio of epidermis finally contained in the intermediate size and product flour is considerably reduced in the sifting after the milling by the third break since, even though the grains are small, a large amount of endosperm is contained inside thereof.

Thus, since the ratio of the epidermis contained in the intermediate size and product flour can be reduced at each breaking step, the quality and the overall yield of the product are enhanced.

According to another aspect of the invention, only the wheat grains obtained by further classifying the material other than the regular wheat grains having been sorted out at the sorting step are forwarded to at least one of downstream breaks at a downstream of the first break thereby producing the flour. In this way, in the material other than the regular wheat grains which have been sorted by the sorting step, there are contained bran particles in addition to small wheat grains and broken grains. These particles including the grains are not directly introduced into breaking steps, but at least the bran particles are first removed by classification so that only the small grains and the broken grains can be forwarded to subsequent breaking steps. The advantage obtained by forwarding the small grains and broken grains to the downstream breaking to which the material containing a large amount of epidermis is forwarded is as explained above, but the forwarding of grains even with the inclusion of the broken grains further enhances the yielding.

The broken grains developed from the regular grains are with comparatively small amount of epidermis so that, when they are introduced into downstream breaking steps, the epidermis contents in the wheat flour produced there are relatively reduced, thus greatly contributing to the enhancement of the quality and yielding of the flour.

According to a further aspect of the invention, by providing the polishing step before the above explained procedures, it is made possible to enhance the advantageous effects of the invention. That is, since the polished wheat grain which is in a state in which the epidermis on the surface of the wheat grain has been removed is introduced into the sorting step, the amount of epidermis is small from the introduction stage, and the invention enables the high yield production of wheat flour whose ash contents are lower.

According to a still further aspect of the invention, the sorting step comprises the polishing step which uses rotary polishing rolls and screens surrounding the polishing rolls. In the screens of the polisher constituting the polishing means, the screen aperture is large enough to allow the passing of the material, including small grains, other than the regular wheat grains.

In recent years, it has become common to use the wheat polisher in a flour milling system. In such polisher, when the screen aperture of at least a part of the screen of the polisher is such that it allows small size wheat grains to pass through, it is possible to sort out small size raw wheat grains while the wheat polishing is carried out and, since the screen aperture is large, the bran removal is also enhanced. The raw wheat grain after the polishing is in a state in which the epidermis at the surface portion other than the crease portion has been substantially removed and only the regular grains (large size grains) can be forwarded to the first break. Further, the sorting means can be realized by simply exchanging the mesh apertures of the screen in the conventional polisher. Also, the sorting means provided for sorting small grains from the raw wheat grains is realized by an extremely simple method, that is, by changing the size of the screen aperture in the conventional polisher to that adapted to small size grains. Thus, in this way, the facility investment can be economized, which will be a great contribution to the industry. As a matter of course, it will also be effective if the size of the aperture in the overall screen is large so as to allow small size grains to pass through.

According to further aspects of the invention, the sorting step is arranged such that, in order to remove the material, including small grains, other than the regular wheat grains, the sorting screen matched to the grain size is rotated or oscillated or that the sorting cylinder is provided with a plurality of indentions and this sorting cylinder is rotated. It is also possible to incorporate the wind sorting to the above, and any kinds of sorting will serve the purpose as long as the sorting is conducted based on sizes of grains.

According to a further aspect of the invention, in the flour milling system having the breaking and grading into which the wheat is introduced, the flour milling system comprises a sorting means for sorting the raw wheat grains into the regular wheat grains and material other than the regular wheat grains, a transporting means for forwarding the regular wheat grains having been sorted by the sorting means to the first break, and another transporting means for forwarding the material other than the regular wheat grains to breaks other than the first break and to at least one of downstream breaks at a downstream of the first break.

The function and effect of the provision of the sorting means are as already explained above. The flour grain transporting means for making connection between the sorting means and downstream breaks does not require any particular transporting means for realizing the flour milling system according to the invention. Such transporting means may be an ordinary transporting means and, since a minimum of one transporting line is sufficient, it is possible to realize the system according to the invention in an extremely economical way.

According to a still further aspect of the invention, there is provided, intermediary of the transporting means, a classifying means which further classifies the material other than the regular wheat grains having been sorted out by the sorting means into the wheat grains and the material other than the wheat grains. Because of the classifying means provided intermediary of the transporting means for classifying the bran, small grains and broken grains taken out from the polisher into small grains, broken grains and other material, with a result that the bran powder taken out from the polisher together with small grains has been removed, only the small grains and the broken grains which become the raw material for the wheat flour are efficiently supplied to downstream breaks. Since the classifying means can be realized by an ordinary cyclone without requiring any special devices, and a minimum of one classifying means with respect to one sorting means is sufficient, it is possible to realize the system in an extremely economical way.

According to yet further aspects of the invention, the wheat polishing means is provided before the sorting means and the wheat polishing means itself is used as the sorting means. Since the use of the wheat polisher in a flour milling system is common in recent years, it is considered easy to add thereto a sorting means or to exchange screens for realizing the system according to the invention, and this also contributes to the economic benefit.

According to still further aspects of the invention, the sorting step can be carried out by means in which the screen is rotated, the screen is vibrated or oscillated, or the sorting cylinder having a number of indentions therein is rotated. Since this sorting means is provided before the first break, it is not necessary to provide this means to individual breaks, thus contributing to economical benefits.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 1:
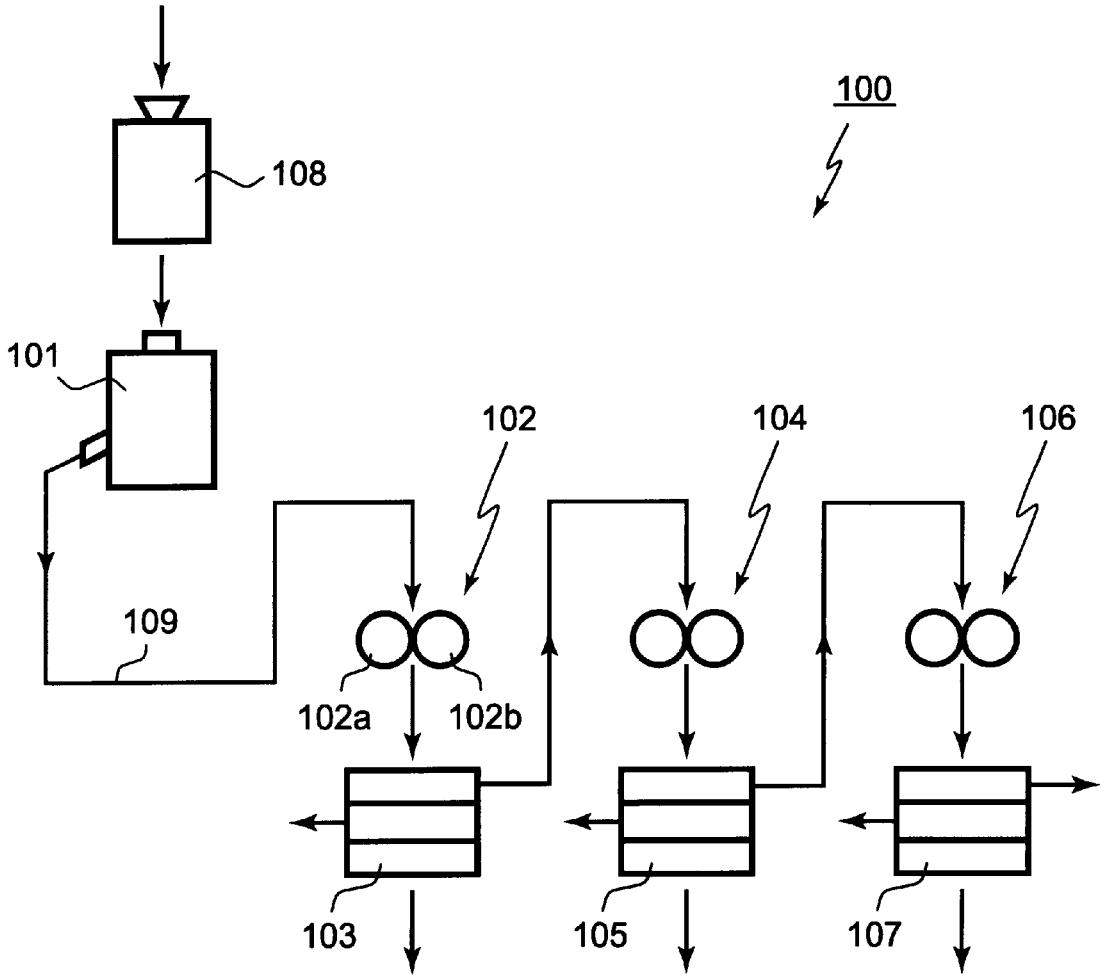
Fig. 1 PRIOR ART
FIG. 1 is a conventional flour milling flow.
Figure 2:
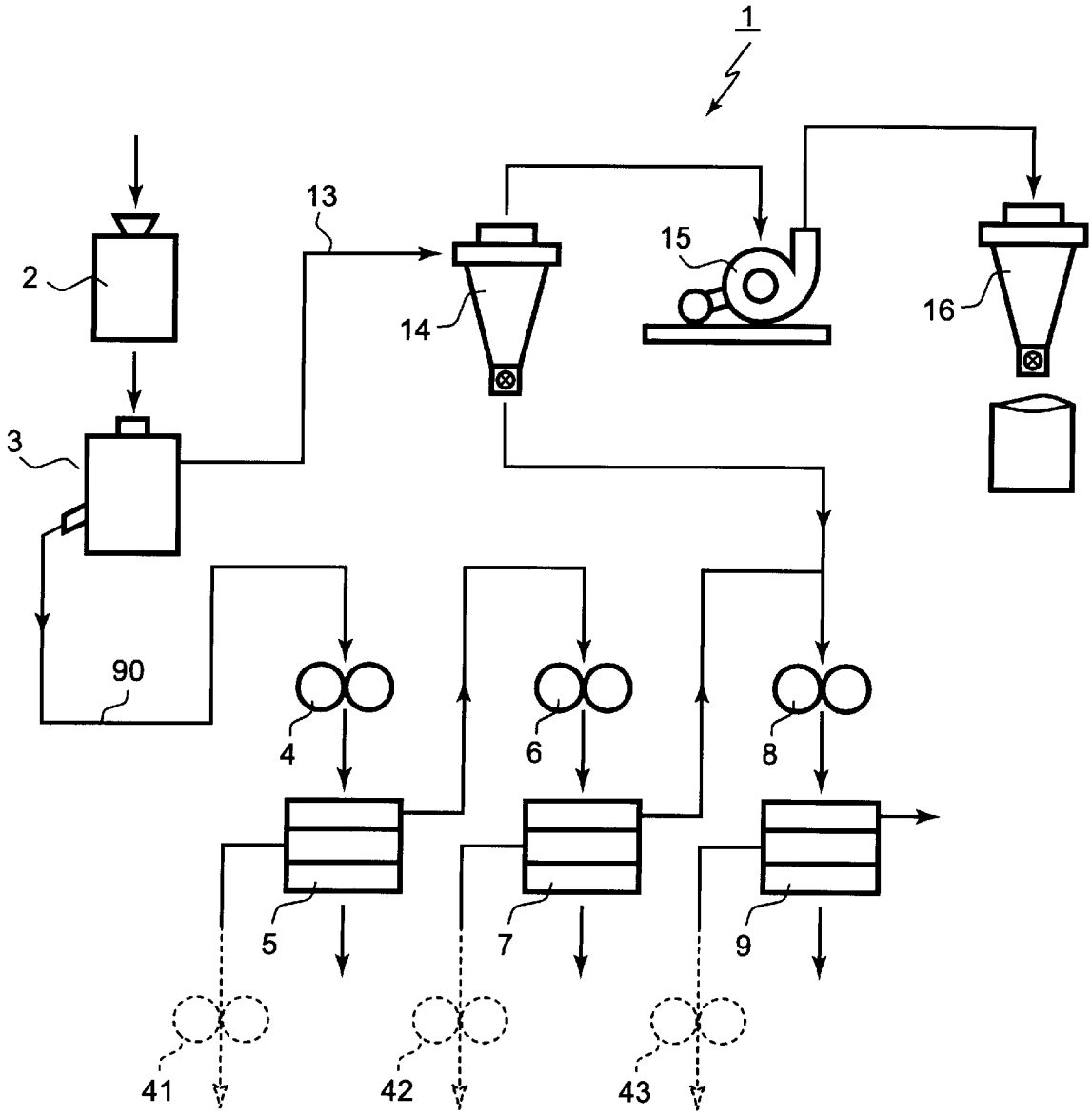
FIG. 2 is a flour milling flow according to a first embodiment of the invention.

The invention will now be described with reference to the drawings. FIG. 2 shows a flour milling flow 1 as a first embodiment of the invention. The raw wheat grains from which foreign materials such as small stones and metal pieces have been removed at a cleaning unit 2 are introduced into a wheat polisher 3 where the epidermis on the surface of the wheat grain is removed by abrasive and friction actions. The wheat grains from which the epidermis has been removed are forwarded to a first break 4 for being milled. The wheat particles having been milled are sifted out by a sifter 5. By the sifter 5, the wheat particles are sifted out to large size wheat particles (larger than 850 μm), intermediate size wheat particles (850 μm–125 μm), and small size wheat particles (smaller than 125 μm), The large size wheat particles are forwarded to a downstream second break 6. The small size wheat particles become product flour after the epidermis including much ash contents therein has further been removed. The intermediate size wheat particles are forwarded to roll mill 41 called smoothing roll mills where the particles are further finely milled.

The large size wheat particles sifted out by the sifter 5 and forwarded to the second break 6 are milled, and the wheat particles having been milled are sifted by a sifter 7. At the sifter 7, the particles are sifted into large size wheat particles (larger than 600 μm), intermediate size wheat particles (600 μm–125 μm), and small size wheat particles (smaller than 125 μm). The large size wheat particles are forwarded to a further downstream third break 8. The small size wheat particles become product flour after the epidermis including much ash contents therein has further been removed. The intermediate size wheat particles are forwarded to roll mills 42 called smoothing roll mills where the particles are further finely milled.

The large size wheat particles sifted out by the sifter 7 and forwarded to the third break 8 are milled, and the wheat particles having been milled are sifted by a sifter 9. At the sifter 9, the particles are sifted into large size wheat particles (larger than 355 μm), intermediate size wheat particles (355 μm–125 μm), and small size wheat particles (smaller than 125 μm). The large size wheat particles are forwarded to further downstream roll mills (not shown). The small size wheat particles become product flour after their ash contents have further been removed. The intermediate size wheat particles are forwarded to roll mills 43 called smoothing roll mills where the particles are further finely milled.

Figure 3:
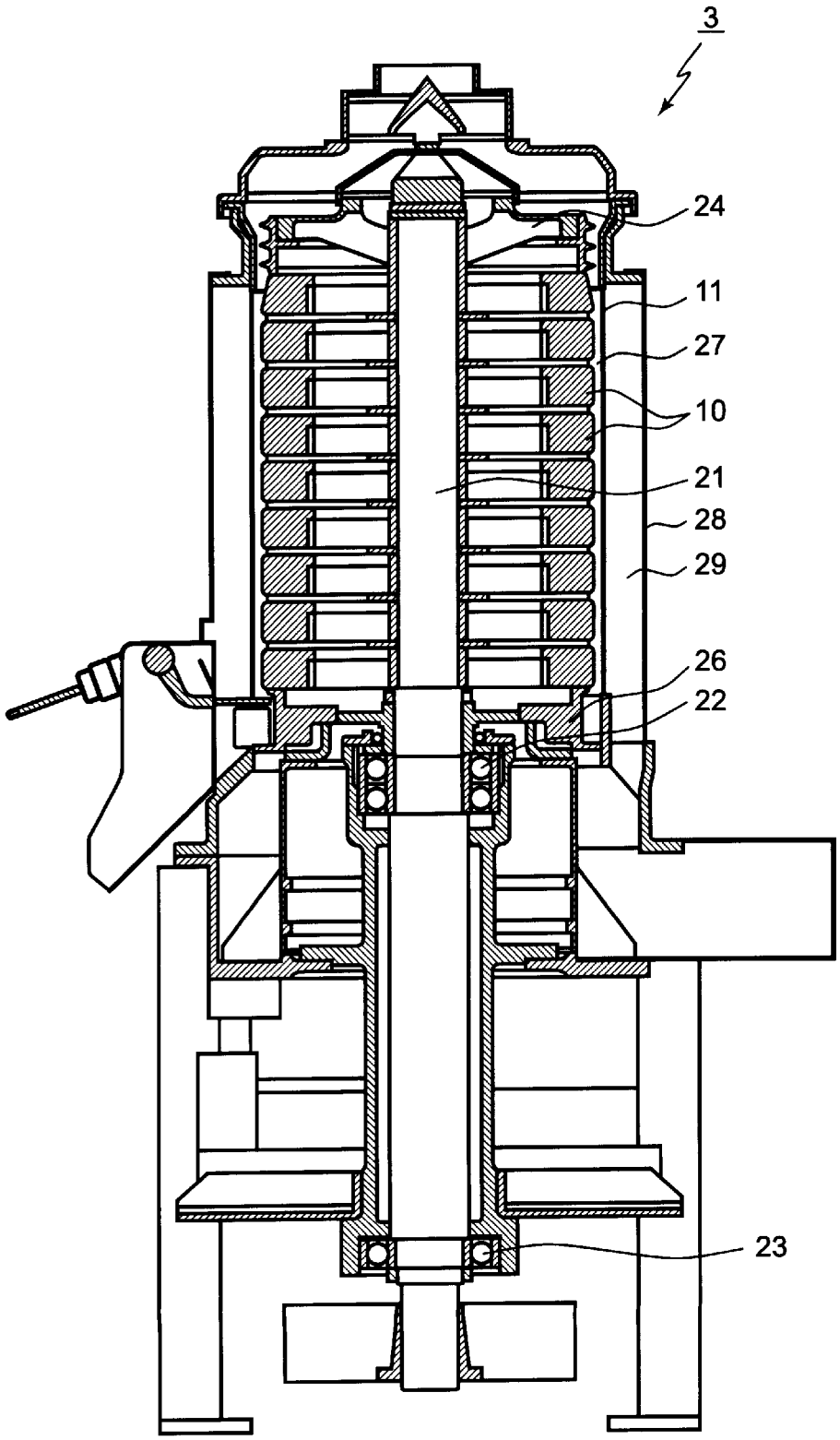
FIG. 3 is a sectional view of a wheat polisher.

According to the present invention, the wheat polisher 3 is constructed as explained below. As shown in FIG. 3, the wheat polisher 3 is so arranged that, within a bran removing perforated cylinder 11 (hereinafter referred to as screen 11), a vertical rotary axis 21 is held by bearings 22, 23. At an upper portion of the vertical axis 21, there is provided a spiral rotor 24 and, at a lower portion of the spiral rotor 24, there are provided a plurality of stacked abrasive rolls 10. Immediately below the abrasive rolls 10, there is provided a discharging rotor 26. The space between the screen 11 and the abrasive rolls 10 forms a polishing chamber 27 and the space between the screen 11 and an outer wall 28 forms a bran removing chamber 29.

Figure 4:
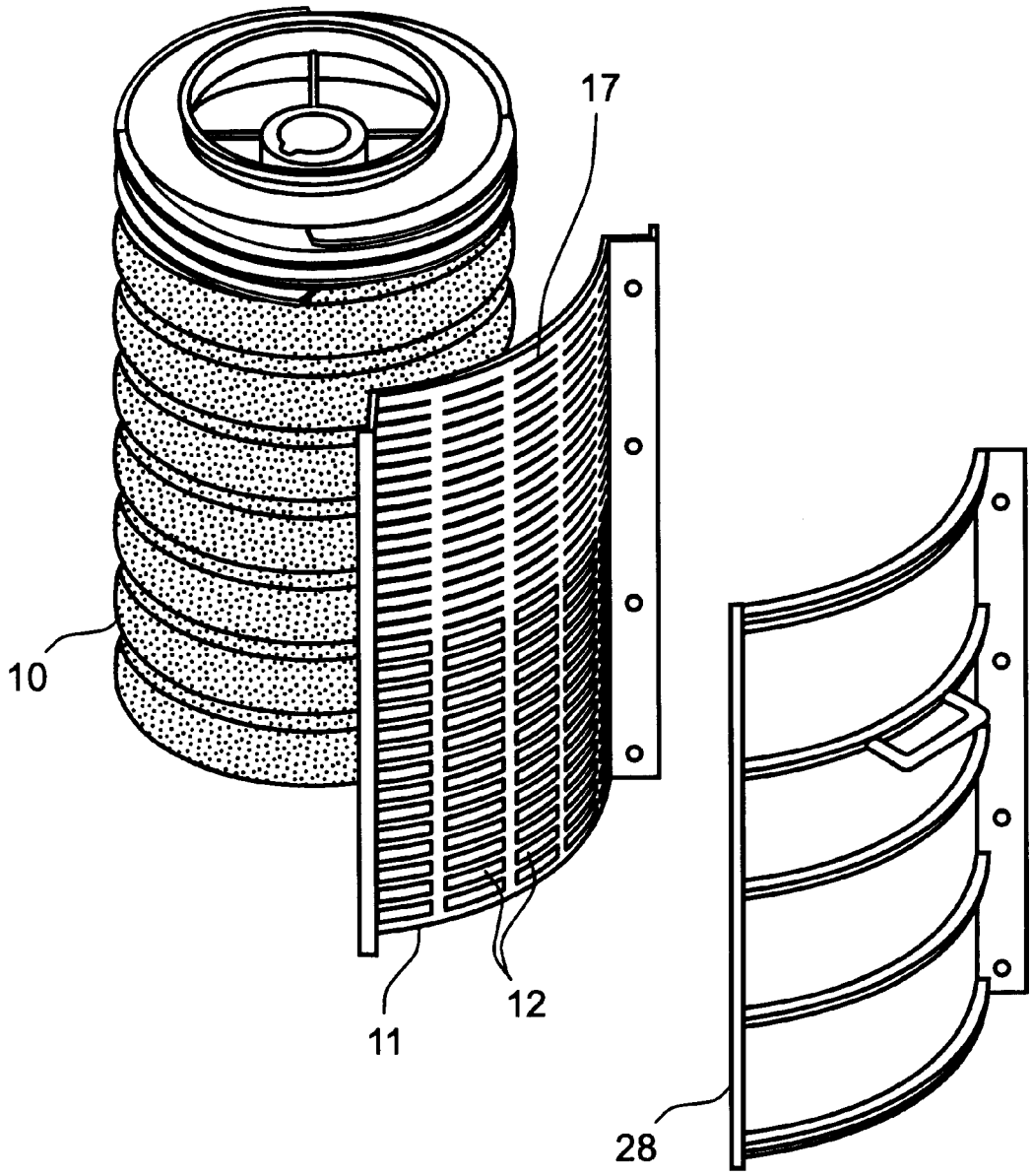
FIG. 4 is a diagram showing positions of the abrasive rolls and the screen used in the embodiment of the invention.

The above construction is of an ordinary vertical type polisher 3. FIG. 4 shows only main elements of such wheat polisher. The raw wheat grains flow between the abrasive rolls 10 and the screen 11 downwardly from above in the polisher shown in FIG. 4. While the raw wheat grains flow down, due to the rotation of the abrasive rolls 10 and the pressure created between the abrasive rolls 10 and the screen 11, the epidermis at the surface of the wheat grain is removed by abrasion.

According to the invention, the apertures 12 of the mesh in the screen 11 provided to the wheat polisher 3 are set to, for example, 1.7 mm which allows the small grains contained in the raw wheat grains to pass through the apertures 12 at a part of the screen 11 to the outside of the screen 11. The apertures 17 at other parts of the screen 11 are set to, for example, 1.1 mm.

According to the above, when the apertures of the mesh are made large enough to allow the small grains to pass through, the small grains together with bran pass through and come out of the screen 11 so that the wheat grains forwarded from the polisher 3 to the first break 4 are only the regular wheat grains. Since the small grains having a comparatively large ratio of epidermis are sorted out and removed, it is possible to reduce the epidermis contained in the overall wheat grains to be forwarded to the first break 4. In this way, for the sorting step in this embodiment, the apertures of the screen 11 of the polisher 3 are made large to be matched to small grains.

Further, in this embodiment, as shown in FIG. 2, there is provided a transporting passage 13 which communicates between the polisher 3 as a sorting means and the third break 8. Through this transporting passage 13, the small wheat grains from the polisher 3 are introduced into the third break 8. The cyclone 14 as a classifying means is provided intermediary of the transporting passage 13. The cyclone 14 makes separation between the small wheat grains and the bran having passed out of the screen 11 together with small wheat grains, so that only the small wheat grains can be forwarded to the third break 8. At this time, since the broken grains which are possibly produced during the polishing and which are the same size as or smaller size than that of the small grains have simultaneously passed out of the screen 11, it is preferred that these broken grains be separated to the small grain side by the cyclone 14.

The transporting passage 13 also serves as a transporting passage for collecting bran from the polisher 3, and the cyclone 14 is connected via a plate fan 15 to a cyclone 16 for collecting the bran.

In the embodiment, it is shown that a part of the screen is provided with a portion having larger apertures, but it is possible for the overall screen to have aperture size of 1.7 mm. In such a case, depending on the kinds of the raw material or on necessities, the ratio of the portion having larger apertures should be changed. The aperture size of 1.7 mm as set forth above is only an example, and this is subject to change depending on how the small wheat grains are determined. Further, the sorting means does not have to be a polisher as other separate sorting means such as a rotating type sorting screen may be used as explained later.

Now, effects of milling after small grains are removed in the system constructed as above are verified by comparing the ash contents of the small and intermediate particles sifted out by the sifter 5 under the first break 4 according to the embodiment of the invention and the ash contents of the small and intermediate particles sifted out by the sifter 103 under the conventional first break 102. Also, the effects resulted from introducing the sorted small wheat grains into at least one of downstream breaks at a downstream of the first break are verified by comparing the ash contents of the small and intermediate particles sifted out by the sifter 9 under the third break 8 according to the embodiment of the invention and the ash contents of the small and intermediate particles sifted out by the sifter 107 under the conventional third break 106. These effects are shown in Table 1 and Table 2.

TABLE 1

COMPARISON OF ASH CONTENTS IN SEMOLINA AND FLOUR UNDER FIRST BREAK

| | | APERTURE SIZE OF SCREEN (mm) | |
|---|---|---|---|
| WHEAT FLOUR | | 1.1 | 1.7 |
| Ash (14% m.b.) | SEMOLINA (125 ~ 850 μm) | 0.882 | 0.787 |
| | FLOUR (125 μm ~) | 0.656 | 0.602 |
| | TOTAL | 0.838 | 0.754 |

TABLE 2

COMPARISON OF ASH CONTENTS IN SEMOLINA AND FLOUR UNDER THIRD BREAK

| | | APERTURE SIZE OF SCREEN (mm) | |
|---|---|---|---|
| WHEAT FLOUR | | 1.1 | 1.7 |
| Ash (14% m.b.) | SEMOLINA (125 ~ 850 μm) | 0.928 | 0.606 |
| | FLOUR (125 μm ~) | 0.802 | 0.613 |
| | TOTAL | 0.896 | 0.608 |

From the Table 1, it is clear that the ash contents are smaller when the aperture size of the screen 11 is 1.7 mm than when it is 1.1 mm. The column 1.1 is for the ash contents, on an individual particle basis, of the particles sifted out by the sifter 103 when the raw wheat grains are introduced as they are into the first break 102. The column 1.7 is for the ash contents, on an individual particle basis, of the particles sifted out by the sifter 5 when the small wheat grains sorted out from the raw wheat grains are introduced into the first break 4. These are the effects resulted from the steps in which the small wheat grains are sorted out and only the regular wheat grains are introduced into the first break 4. From the Table, it is clearly seen that the ash contents are surely reduced.

From the Table 2, it is clear that the ash contents are smaller when the aperture size of the screen 11 is 1.7 mm than when it is 1.1 mm. The column 1.1 is for the ash contents, on an individual particle basis, of the particles sifted out by the sifter 107 when only the large particles from the second break 105 are introduced into the third break 106 in a conventional way. The column 1.7 is for the ash contents, on an individual particle basis, of the particles sifted out by the sifter 9 when the small wheat grains sorted out from the raw wheat grains and the large particles from the second break are introduced into the third break 8.

The lowering of the ash contents in the intermediate particles and the small particles as explained above leads to the enhancement of the quality of the wheat flour produced, and also to the enhancement of the overall yield. The particle sizes of the particles sifted by each sifter as shown in the above embodiment are appropriately set by changing the aperture sizes of the sifter and the change is effected in individual flour milling systems and individual roll mills. Further, the number of roll mills and the means connected to such as sifters should be changed according to needs in individual flour milling systems.

Figure 5:
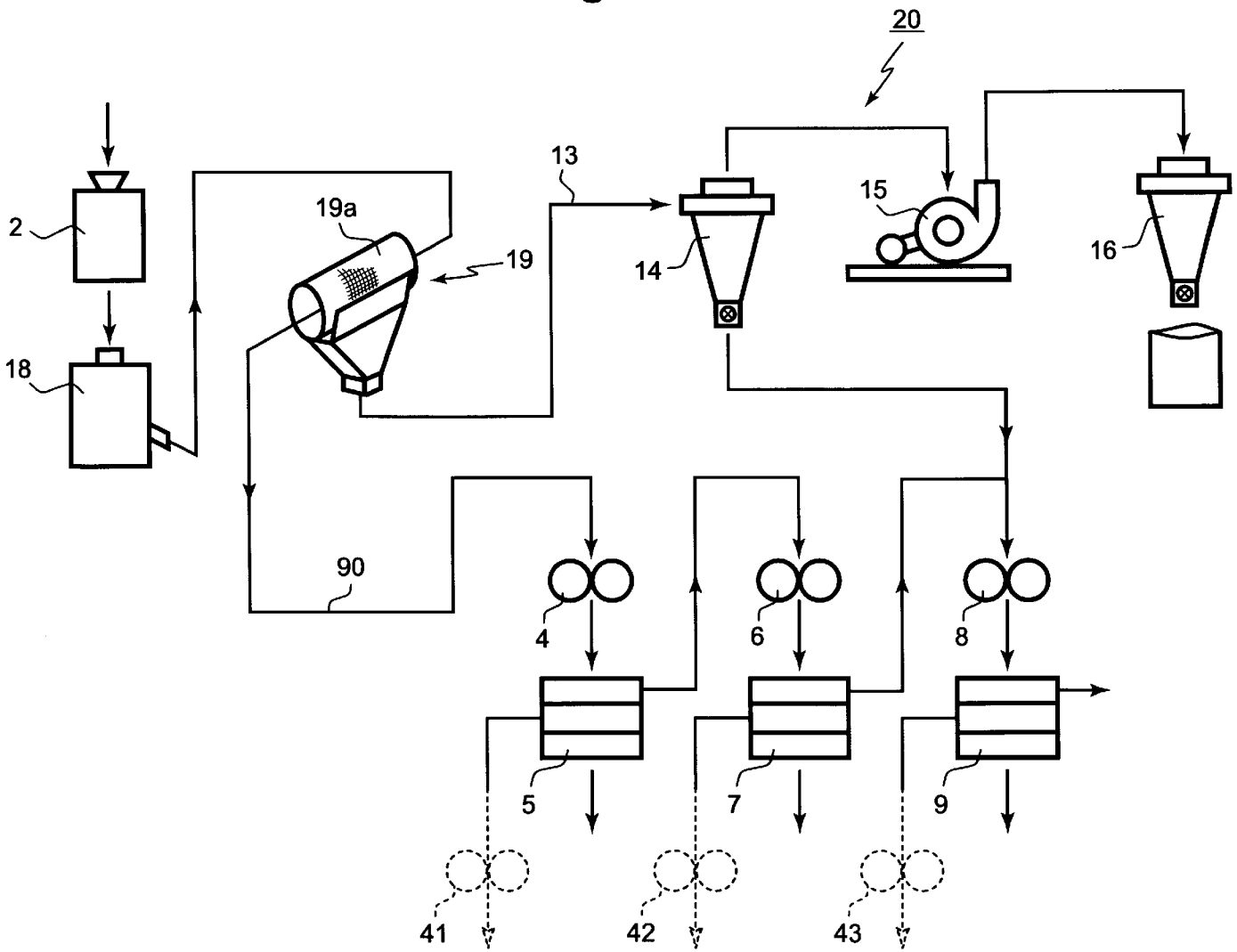
FIG. 5 is a flour milling flow according to a second embodiment the invention.

FIG. 5 shows a flour milling flow 20 as a second embodiment of the invention. The raw wheat grains from which foreign materials such as small stones and metal pieces have been removed at a cleaning unit 2 are introduced into a polisher 18 where the epidermis on the surface of the wheat grain is removed. The wheat grains from which the epidermis at the surface portion except the crease portion has been substantially removed are sorted in grain sizes by the rotary sorting unit 19 and the regular wheat grains above a certain grain size are forwarded to a first break 4 for being milled. Also, the small grains and broken grains which are smaller than the certain grain size are introduced into and milled at downstream breaks at a downstream of the first break. The wheat particles having been milled are sifted out by a sifter 5. By the sifter 5, the wheat particles are sifted out to large size wheat particles (larger than 850 μm), intermediate size wheat particles (850 μm–125 μm), and small size wheat particles (smaller than 125 μm). The large size wheat particles are forwarded to a downstream second break 6. The small size wheat particles become product flour after the epidermis including much ash contents therein has further been removed. The intermediate size wheat particles are forwarded to roll mills 41 called smoothing roll mills where the particles are further finely milled.

The large size wheat particles forwarded to the second break 6 from the sifter 5 are milled, and the wheat particles having been milled are sifted by a sifter 7. At the sifter 7, the particles are sifted into large size wheat particles (larger than 600 μm), intermediate size wheat particles (600 μm–125 μm), and small size wheat particles (smaller than 125 μm). The large size wheat particles are forwarded to a further downstream third break 8. The small size wheat particles become product flour after the epidermis including much ash contents therein has further been removed. The intermediate size wheat particles are forwarded to roll mills 42 called smoothing roll mills where the particles are further finely milled.

The large size wheat particles forwarded to the third break 8 from the sifter 7 are milled, and the wheat particles having been milled are sifted by a sifter 9. At the sifter 9, the particles are sifted into large size wheat particles (larger than 355 μm), intermediate size wheat particles (355 μm–125 μm), and small size wheat particles (smaller than 125 μm). The large size wheat particles are forwarded to further downstream roll mills (not shown). The small size wheat particles become product flour after the epidermis including much ash contents therein has further been removed. The intermediate size wheat particles are forwarded to roll mills 43 called smoothing roll mills where the particles are further finely milled.

According to this embodiment, the rotary sorter 19 is used for sorting the raw wheat grains by grain sizes before being milled. In this rotary sorter 19, the apertures of the mesh therein are set to, for example, 1.7 mm which allows the small grains contained in the raw wheat grains to pass through the apertures of the screen 19*a* and come out to the outside of the screen 19*a* during the rotation thereof.

In this way, when the apertures of the mesh are made large to be matched to small grains, small grains together with bran pass through and come out of the screen 19*a* during the sorting so that the wheat grains forwarded from the rotary sorter 19 to the first break 4 are only the regular wheat grains. Since the small grains having a comparatively large ratio of epidermis are sorted out, it is possible to reduce the epidermis contained in the overall wheat grains to be forwarded to the first break 4. In this way, in the sorting step in this embodiment, the apertures of the screen 19*a* of the rotary sorter 19 are made large to be matched to small grains.

Further, in this embodiment, as shown in FIG. 5, there is provided a transporting passage 13 which communicates between the rotary sorter 19 and the third break 8. Through this transporting passage 13, small wheat grains from the rotary sorter 19 are introduced into the third break 8. A cyclone 14 as a classifying means is provided intermediary of the transporting passage 13. The cyclone 14 makes separation between the small wheat grains and the bran having passed out of the screen 19*a* together with small wheat grains, so that only the small wheat grains can be forwarded to the third break 8. At this time, the broken grains which are possibly produced during the polishing and which are the same size as or smaller size than the small size grains have simultaneously passed out of the screen 19*a*, it is preferred that these broken grains be separated to the small wheat grain side by the cyclone 14.

The transporting passage 13 may serve also as a transporting passage for collecting bran from other means, in which case the cyclone 14 is connected via a plate fan 15 to a cyclone 16 for collecting the bran.

In the embodiment, an example is shown wherein the aperture size of the screen is 1.7 mm, but the aperture size may well be outside 1.7 mm depending on the kinds of the raw wheat grains and be subject of change depending on the kinds of the raw material or on the necessities. Also, the aperture size should appropriately be changed depending on how the small wheat grains are determined.

As above, the ash contents in the particles of intermediate and small sizes sifted out by the sifter can surly be reduced as in the first embodiment. That is, by practicing or employing the method wherein the regular wheat grains having been sorted out by grain sizes are introduced into the first break, and the wheat grains smaller than small grains are forwarded to downstream breaks at a downstream of the first break, it is possible to produce quality flour with high yields as aimed at by the present invention.

Figure 6:
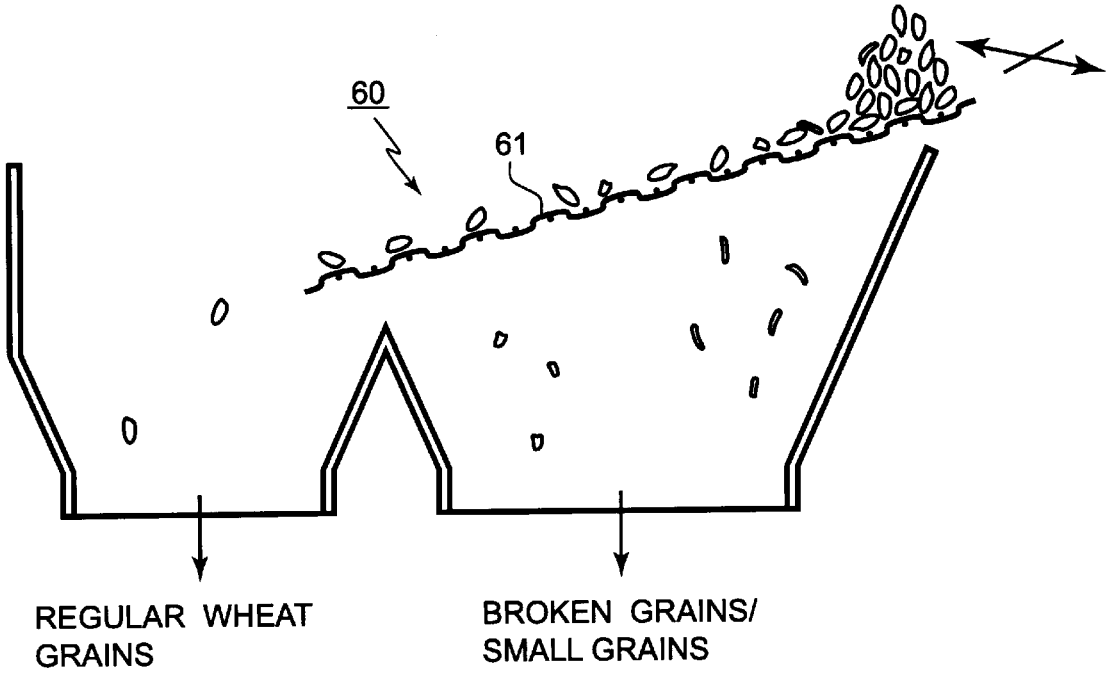
FIG. 6 is an example wherein a sorting means employs a sorting screen in a plate-like form.
Figure 7:
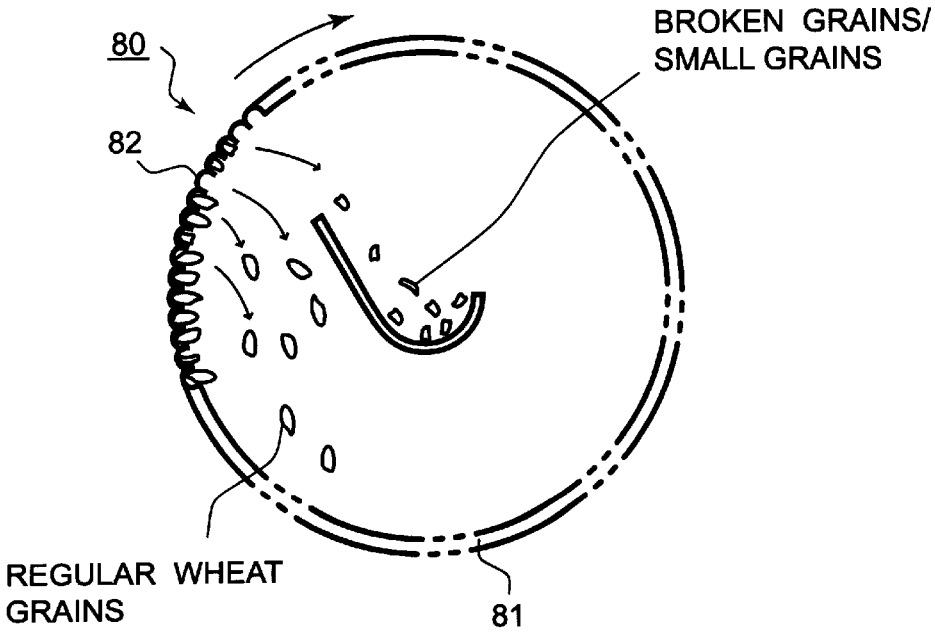
FIG. 7 is an example wherein a sorting means employs a sorting cylinder having indentions on an inside surface thereof.

In this embodiment, the sorter 19 has been shown as being one in which the cylindrically formed screen 19*a* rotates around the central axis of the cylinder, but this may be, as shown in FIG. 6, an oscillating sorter or separator 60 in which the screen 61 which is in a plate form and which is inclined is vibrated or oscillated, and the raw wheat grains before milling are introduced thereon, thus sorting the raw wheat grains into the regular wheat grains and small grains/broken grains. Also, as shown in FIG. 7, it is possible to make the sorting by an indent cylinder 80 in which a cylinder 81 equipped with a number of indentions 82 on the inner surface thereof rotates, and the small grains/broken grains are sorted and removed by lengths thereof. It is also possible to use a disk, instead of the cylinder, with the indentions provided on the surface thereof in a similar way.

In the second embodiment, an example has been shown wherein the polisher 18 is provided before the sorter 19. However, the object of the invention for enhancing the yield can be achieved also by not providing the polisher. The effect of the invention without the provision of the polisher becomes clear when compared with the conventional flour milling flow without the polisher. That is, where the regular wheat grains are introduced into the first break 4 with the sorting step being provided, irrespective of whether the polisher is provided, the effect of lowering the ratio of the epidermis contents with respect to the endosperm compared with the case where the raw material contains small grains is clear. Further, where the small grains and broken grains are introduced into downstream breaks at a downstream of the first break, the effect of lowering the ratio of the epidermis contents by the milling at the break to which the grains are introduced is clear irrespective of whether the polisher is provided.

According to the invention, it is important that the regular wheat grains sorted by the sorting means can be introduced into the first break 4 and the small grains and broken grains sorted by the same sorting means can be introduced into downstream breaks at a downstream of the first break 4. In the embodiment, there are no restrictions in the positions of the sorting means and the number of the sorting means. Also, one polisher has been shown as an example, but this is not limiting and there can be two serially connected polishers, one for polishing and the other for polishing and sorting.

Where the sorting step is added before the first break and only the regular wheat grains after the removal of the small grains from the raw wheat grains are introduced into the first break, since there are no small grains whose epidermis contents are comparatively large with respect to the endosperm of the wheat, the ratio of the epidermis in the wheat flour milled by the first break is inherently low. Thus, it is possible to produce better quality wheat flour. Also, where the small grains sorted by the sorting step are introduced into a downstream break at which the ratio of the epidermis with respect to the endosperm is high, even though the grains are small, the ratio therein of the epidermis with respect to the endosperm is low, so that it is possible to lower the ratio of the epidermis at downstream breaks.

Where the aperture of the mesh of the screen in the polisher used in the flour milling is such that it allows the small grains to pass therethrough, it is possible to sort out only the raw wheat grains in small sizes, to introduce only the regular grains (large grains) to the first break, and to make the wheat grains best suited for the flour milling. Further, since the sorting means is such that it is possible to be realized by simply changing the aperture of the mesh of the screen in the polisher, the costly investment can be avoided.

Even with the conventional milling system having no polisher, where the sorting step is provided before the first break and the raw wheat grains are sorted into the regular wheat grains and small grains/broken grains, and where only the regular wheat grains are introduced into the first break, there is produced the same effect that the ratio of the epidermis is lowered at the first break and also, by introducing the small grains/broken grains into downstream breaks, there is produced the same effect that the ash contents are reduced thereby enabling the production of high yield flour.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A flour milling method for raw wheat grains comprising the steps of:

milling said raw wheat grains in a plurality of milling steps whose milling degrees are different from one another sequentially from an upstream position to a downstream position, each of said milling steps including a breaking step and a grading step;

sorting said raw wheat grains into regular wheat grains and material other than said regular wheat grains;

forwarding the sorted regular wheat grains to a most upstream milling step of said plurality of milling steps; and forwarding the sorted material other than said regular wheat grains sorted by the sorting step to at least one milling step downstream of said most upstream milling step.

2. A flour milling method for raw wheat grains according to claim 1, further comprising a classifying step for obtaining wheat grains only from said material other than said regular wheat grains prior to said forwarding step of the material other than said regular wheat grains to at least one of said downstream milling steps.

3. A flour milling method for raw wheat grains according to claim 1, further comprising a polishing step for polishing the raw wheat grains before said sorting step.

4. A flour milling method for raw wheat grains according to claim 1, in which said sorting step is performed simultaneously with a polishing action in a polishing chamber of a polisher which is defined between rotary polishing rolls and a screen surrounding said rotary polishing rolls and having mesh apertures which allow material, including small grains, other than the regular wheat grains to pass through.

5. A flour milling method for raw wheat grains according to claim 1, in which, in order to remove material, including small grains, other than the regular wheat grains, said sorting step is performed by rotating or oscillating a sorting screen having mesh apertures which allow material, including small grains, other than the regular wheat grains to pass through.

6. A flour milling method for raw wheat grains according to claim 1, in which said sorting step is performed by rotating a cylinder having a plurality of indentions formed therein.

7. The method of claim 1, wherein sorting the raw wheat grains comprises sorting the raw wheat grains according to a grain size.

8. The method of claim 1, wherein the material other than the regular wheat grains comprises wheat grains of a size smaller than the regular wheat grains.

9. A flour milling system for raw wheat grains comprising:

a plurality of milling means whose milling degrees are different from one another, arranged sequentially from an upstream position to a downstream position, a sorting means for sorting the raw wheat grains into regular wheat grains and material other than said regular wheat grains;

a first transporting means for forwarding the regular wheat grains sorted by said sorting means to a most upstream milling means of said plurality of milling means; and a second transporting means for forwarding the material other than said regular wheat grains sorted by said sorting means to at least one milling means downstream of said most upstream milling means.

10. A flour milling system according to claim 9, further comprising a classifying means disposed intermediary of said second transporting means, for classifying the material other than the regular wheat grains sorted by said sorting means further into wheat grains and material other than said wheat grains.

11. A flour milling system according to claim 9, further comprising a polishing means for polishing the raw wheat grains.

12. A flour milling system according to claim 9, in which said sorting means is provided with a polisher having rotary polishing rolls and a screen surrounding said polishing rolls and having, at least partly, mesh apertures which allow small grains to pass through.

13. A flour milling system according to claim 9, in which, in order to remove the material, including small grains, other than the regular wheat grains, said sorting means is a rotary sorting means in which a sorting screen is a cylindrical form and has mesh apertures which allow material, including small grains, other than the regular wheat grains to pass through.

14. A flour milling system according to claim 9, in which, in order to remove the material, including small grains, other than the regular wheat grains, said sorting means is an oscillating sorting means in which a sorting screen in a plane form having mesh apertures which allow material, including small grains, other than the regular wheat grains to pass through is oscillated.

15. A flour milling system according to claim 9, in which, in order to remove the material, including small grains, other than the regular wheat grains, said sorting means is a rotary sorting means in which a sorting cylinder having a number of indentions matched to grain sizes of said material other than the regular wheat grains is rotated.

16. The system of claim 9, wherein the sorting means for sorting raw wheat grains is configured to sort the raw wheat grains according to a grain size.

17. The system of claim 9, wherein the material other than the regular wheat grains comprises wheat grains of a size smaller than the regular wheat grains.

* * * * *

UNITED STATES PATENT AND TRADEMARK OFFICE

CERTIFICATE OF CORRECTION

PATENT NO. : 6,199,777 B1
DATED : March 13, 2001
INVENTOR(S) : Satoru Satake et al.

It is certified that error appears in the above-identified patent and that said Letters Patent is hereby corrected as shown below:

Column 5,
Line 10, after "embodiment", -- of -- should be inserted.

Signed and Sealed this

Fourth Day of December, 2001

*Attest:*

Nicholas P. Godici

NICHOLAS P. GODICI
*Acting Director of the United States Patent and Trademark Office*

*Attesting Officer*